United States Patent [19]

Toledano

[11] Patent Number: 4,953,373

[45] Date of Patent: Sep. 4, 1990

[54] KEY REMOVABLE CORE BODY

[75] Inventor: Abraham Toledano, Laval, Canada

[73] Assignee: Ilco Unican Inc., Montreal, Canada

[21] Appl. No.: 349,573

[22] Filed: May 9, 1989

[51] Int. Cl.[5] ..... E05B 27/00

[52] U.S. Cl. ..... 70/369; 70/493

[58] Field of Search ..... 70/337, 340, 493, 367–369, 70/371–373, 379 R, 380, 375

[56] References Cited

U.S. PATENT DOCUMENTS

| | | | |
|---|---|---|---|
| 1,384,022 | 7/1921 | Best | 70/340 |
| 2,370,862 | 3/1945 | Johnstone | 70/369 X |
| 2,814,941 | 12/1957 | Best | 70/369 X |
| 3,713,310 | 1/1973 | Surko, Jr. | 70/493 |
| 4,282,731 | 8/1981 | Taksony | 70/493 |
| 4,328,690 | 5/1982 | Oliver | 70/369 |
| 4,386,510 | 6/1983 | Best et al. | 70/369 |
| 4,444,034 | 4/1984 | Best et al. | 70/369 |

FOREIGN PATENT DOCUMENTS

| | | | |
|---|---|---|---|
| 548980 | 10/1956 | Italy | 70/367 |

*Primary Examiner*—Gary L. Smith
*Assistant Examiner*—Suzanne L. Dino
*Attorney, Agent, or Firm*—Fishman, Dionne & Cantor

[57] ABSTRACT

The cross-section of the core body defines a peripheral profile. The core body includes a plug housing and a tumbler pin housing, and at least two separately controllable control elements are mounted in the plug housings. Each of the control elements includes a retainer lug and the retainer lugs are movable between a retracted position, when they are substantially completely within the profile, and an extended position, when they project laterally of the core body outside of the profile.

5 Claims, 7 Drawing Sheets

KEY REMOVABLE CORE BODY

BACKGROUND OF INVENTION

1. Field of the Invention

The invention relates to a key removable core body with anti-picking features. More specifically, the invention relates to such a key removable core body having two or more separate control elements.

2. Description of Prior Art

Key removable core bodies for removable core body locks are known in the art as illustrated in U.S. Pat. Nos. 4,328,690, Oliver, May 11, 1982, 4,386,510, Best et al, June 7, 1983, and 4,444,034, Best et al, Apr. 24, 1984.

The '510 patent teaches the use of a control element (26 in FIG. 1) which includes a retaining lug 32 for retaining the core body 10 in, for example, a cylinder shell 34 (FIG. 2).

In a like manner, the '690 patent teaches a single control element 22. The use of a single control element permits relatively easy picking of the arrangement to remove the core body therefrom. In addition, its pull resistance is relatively limited.

The '034 patent provides a measure of improvement over the above-noted patents in that it increases the pull resistance so that it is not as easy to pull the core body out of its surrounding shell as in the prior art. For this purpose, the '034 patent teaches a control element 60 (see FIG. 3) having two lugs, 61 and 65. However, both of the lugs are mounted on a single control sleeve so that, in effect, there is only a single control element in the '034 patent.

SUMMARY OF INVENTION

It is therefore an object of the invention to provide a key removable core body which cannot be as easily picked to remove the core body from its surrounding housing.

It is a more specific object of the invention to provide such a key removable core body having two or more control elements.

In accordance with the invention, a key removable core body has two or more control elements. The control elements comprise lugs which extend into grooves of the housing surrounding the core body whereby to prevent the core body from being removed from the surrounding housing. The lugs extend out of the core body to retain the core body in place in the surrounding housing. The lugs can be retracted to within the outer periphery of the core body whereby the core body can be withdrawn from the surrounding housing.

In one embodiment, all of the lugs extend from the same side of the core body.

In a second embodiment, the lugs extend from different sides of the core body.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
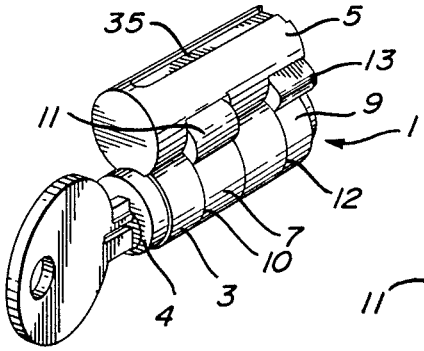
FIG. 1 is a perspective view of a key removable core body in accordance with the invention wherein the control elements extend out of one side of the core body.

Referring to FIG. 1, the core body, illustrated generally at 1, comprises a plug housing 3 in which a plug 4 (see also FIGS. 5 and 6) is rotatably mounted. The plug housing 3 is cylindrical, and a tumbler pin housing 5, comprises a second cylinder which is disposed in intersecting relationship with the plug housing 3 whereby the cross-sectional shape of the core body is a FIG. 8. The core body comprises a centrally disposed control element 7 and an end disposed control element 9. The control element 7 includes a lug 11 and the control element 9 includes a lug 13.

Figure 2:
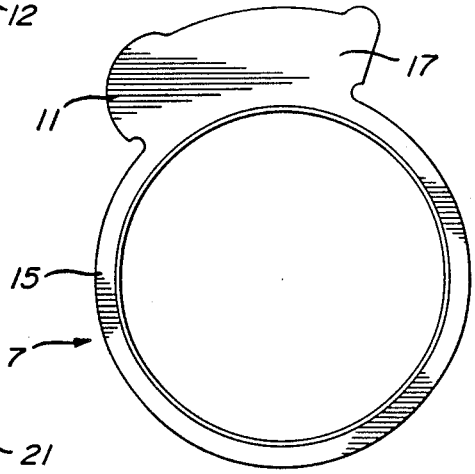
FIG. 2 illustrates a centrally positioned control element in accordance with the invention.

Referring to FIG. 2, the control element 7 comprises a lower ring portion 15 and a thickened portion 17. As can be seen, the lug 11 extends from the thickened portion.

Figure 3:
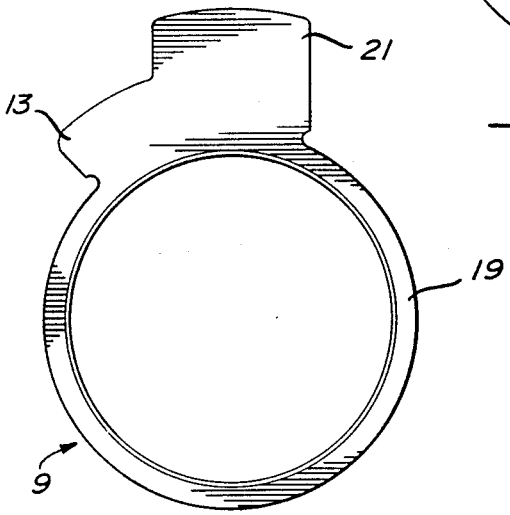
FIG. 3 illustrates an end positioned control element in accordance with the invention.

The end control element is shown in FIG. 3 and includes a lower ring portion 19 and a thickened portion 21. Lug 13 once again extends from the thickened portion.

The control elements 7 and 9 are disposed in recesses 10 and 12 respectively (see FIG. 1) of the plug housing.

Figure 4:
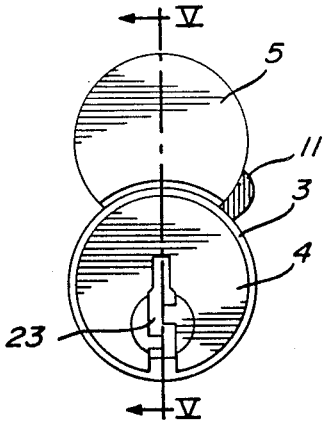
FIG. 4 is a front view of FIG. 1 with the key removed.
Figure 5:
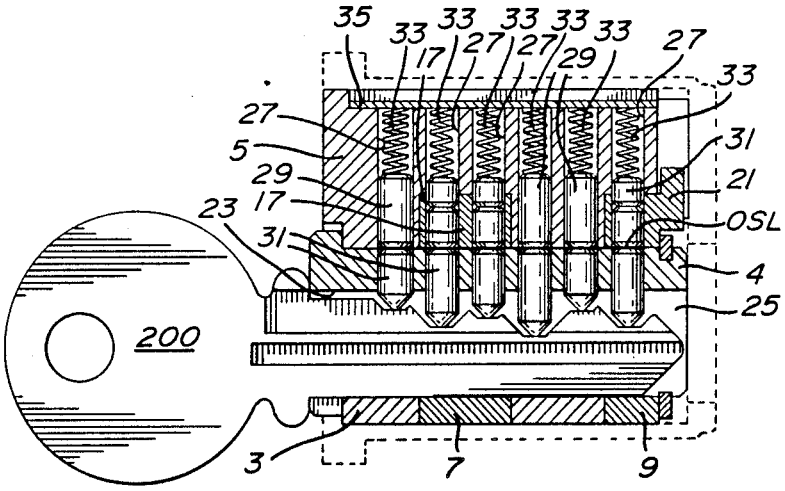
FIG. 5 is a vertical section of FIG. 1 with an operating key inserted.
Figure 6:
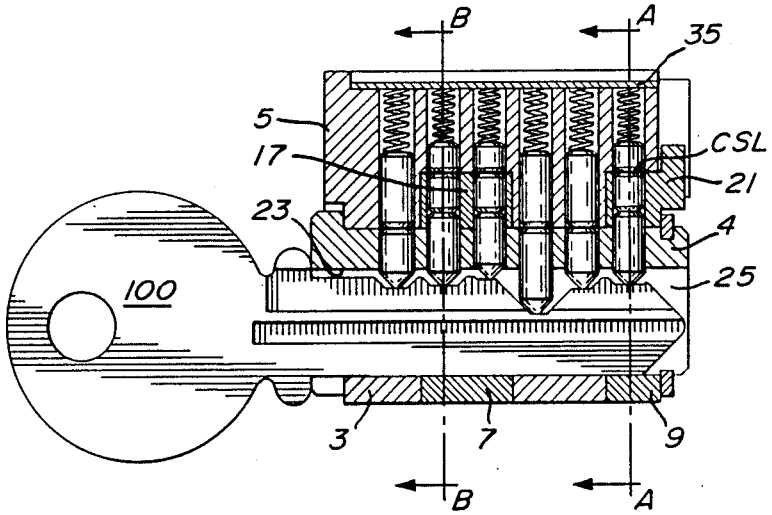
FIG. 6 is a vertical section of FIG. 1 with a control key inserted.

As seen in FIG. 4, the front end of the plug 4 comprises a key hole opening 23. Referring to FIGS. 5 and 6, the key hole opening 23 continues as key hole 25.

A plurality of tumbler pin bores 27 (six shown in FIGS. 5 and 6) extend through the tumbler pin housing, the thickened portions of the control elements, and the top of the plug. Segmented tumbler pins, as is well known in the art, are disposed in the tumbler pin bores. Tumbler pins 29, which are not adjacent the thickened portions 17 or 21, are hereinafter referred to as plug tumbler pins. Tumbler pins 31, which are adjacent the thickened portions 17 and 21, and therefore permit or prevent rotation of the control elements 7 and 9, are hereinafter referred to as control tumbler pins. Springs 33 bias the tumbler pins downwardly, and plate 35 is provided for preventing the tumbler pins from falling out of the tumbler pin bores.

Figure 7:
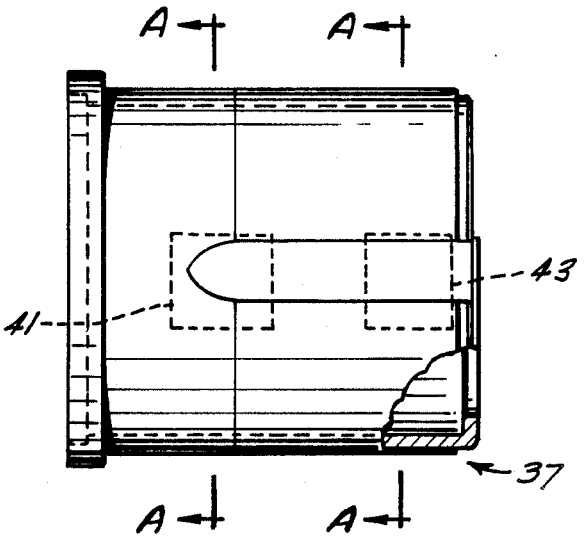
FIG. 7 illustrates a cylindrical shell in which the core body is inserted.
Figure 8:
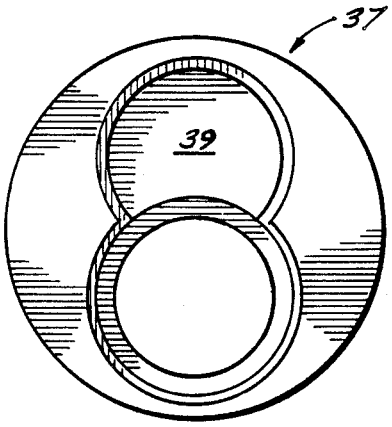
FIG. 8 is a front view of FIG. 7.
Figure 9:
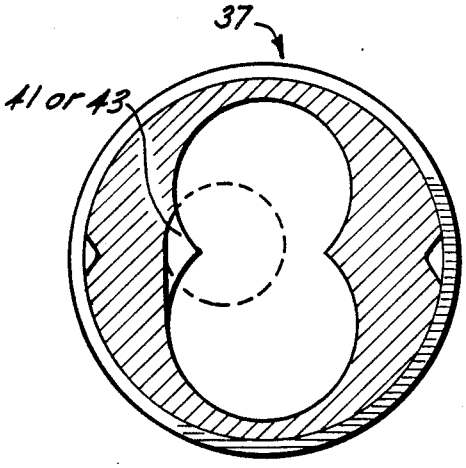
FIG. 9 is a section through A—A of FIG. 7.

The core body 1, as is well known in the art, is inserted into a surrounding housing which can comprise a cylinder shell, a door knob, a lever, etc. The surrounding housing, for illustrative purposes, is shown in FIGS. 7, 8 and 9 as a cylinder shell 37. As can be seen, the front opening 39 of the cylinder shell 37 has the same FIG. 8 shape as the cross-sectional shape of the core body.

As seen in FIGS. 7 and 9, grooves 41 and 43 are worked into one side of the inner wall of cylinder shell 37. The grooves may be worked into the wall by, for example, milling.

Figure 6A:
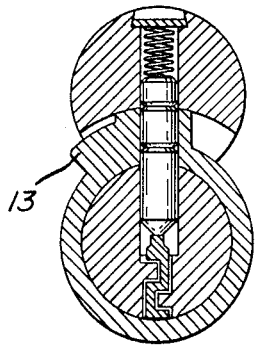
FIGS. 6A and 6B are sections through A—A, B—B respectively of FIG. 6 with the lugs extended.
Figure 6B:
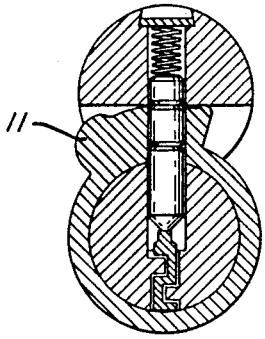
Figure 6C:
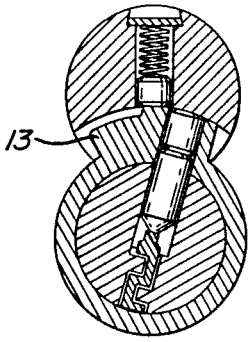
FIGS. 6C and 6D are sections through A—A, B—B respectively of FIG. 6 with the lugs retracted.
Figure 6D:
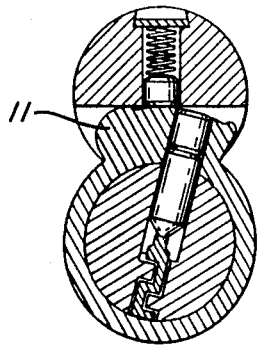

As seen in FIG. 6, when a control key 100 is inserted into the key hole 25, break-away portions of the tumbler pins are aligned along the control shear line (CSL) so that the thickened portions 17 and 21 are free to rotate. At the same time, the thickened portions 17 and 21 are locked for rotational movement with plug 4. Accordingly, when control key 100 is rotated in one direction, (clockwise in the illustrated embodiment), then lugs 11 and 13 will extend out of the outline of the periphery of the cross-sectional shape of the core body, (see FIGS. 6A & 6B) and when control key 100 is rotated in the opposite direction, then lugs 11 and 13 will be retracted (see FIGS. 6C & 6D) so that they are fully within the peripheral outline of the core body.

In operation, to insert the core body into the cylinder shell, the control key of FIG. 1 is rotated in a counterclockwise direction so that the key is no longer vertically disposed. This will retract lugs 11 and 13 to within the peripheral profile of the core body so that the core body can be inserted into the cylinder shell 37 through the front opening 39 thereof. When the core body 1 is so inserted into the cylinder shell 37, the key is rotated in a clockwise direction so that lugs 11 and 13 will extend out of the peripheral outline of the core body and into grooves 41 and 43 respectively. With the lugs disposed in the grooves, the core body can no longer be pulled out of its surrounding housing.

It can be seen, with respect to FIG. 6, that picking the lock to permit removal of the core body from its surrounding housing is more difficult than it would have been with prior art arrangements. For example, if the combination with respect to thickened part 17 is obtained, it will still not be possible to remove the core body from its surrounding housing as lug 13 of thickened part 21 would still be disposed in its groove 43. Accordingly, in order to pick the lock, one must obtain the correct combinations for both thickened part 17 and thickened part 21.

When operating key 200 is inserted into key hole 25, as shown in FIG. 5, break-away parts of the tumbler pins will be aligned along operating shear line (OSL) so that only the plug is rotatable. This is, of course, similar to the situation of prior art arrangements.

Figure 10:
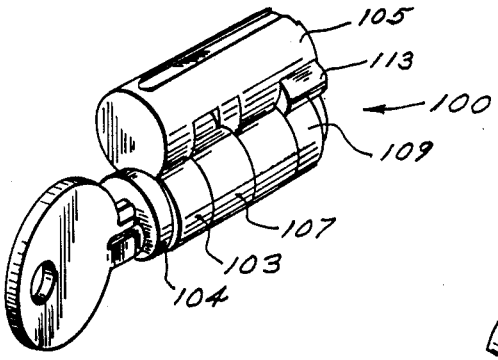
FIG. 10 is a perspective view of an embodiment wherein control elements extend from both sides of the core body, and showing one of the extending lugs.
Figure 11:
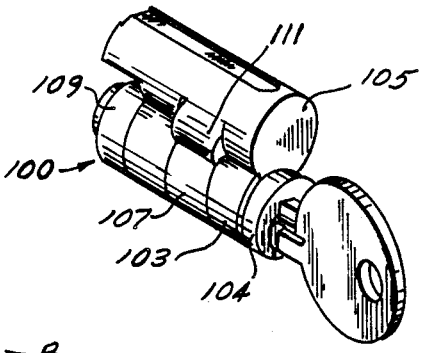
FIG. 11 is a perspective view of the embodiment of FIG. 10 showing the other one of the extending lugs.

In the embodiment illustrated in FIGS. 1 to 9, both of the lugs 11 and 13 extend from the same side of the core body 1. FIGS. 10 to 17 illustrate an embodiment wherein the lugs extend out of opposite sides of the core body. Turning to FIGS. 10 and 11, the core body 100 once again includes a plug housing 103 into which is inserted a plug 104. The plug housing comprises a cylinder as does also the tumbler pin housing 105. The two cylinders are disposed in intersecting relationship whereby the cross-sectional shape of the core is, once again, a FIG. 8.

The core body once again includes two control elements 107 and 109. However, lug 113 of control element 109 extends from the right-hand side of the core body whereas lug 111 of control element 107 extends from the left-hand side of the core body.

Figure 18:
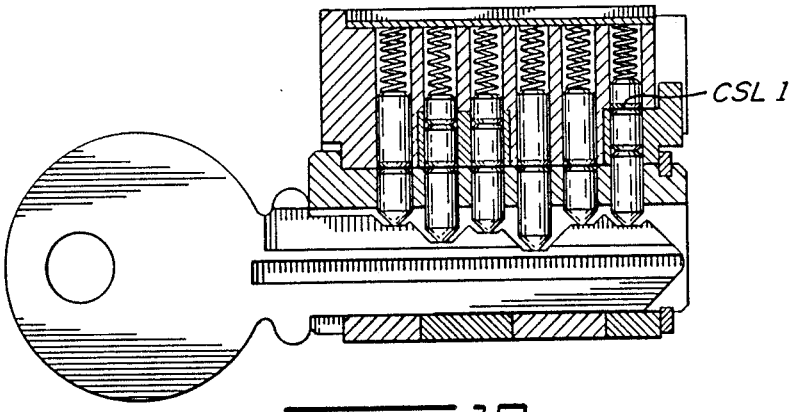
FIG. 18 illustrates one control shear line of the FIGS. 10 to 17 embodiment.
Figure 19:
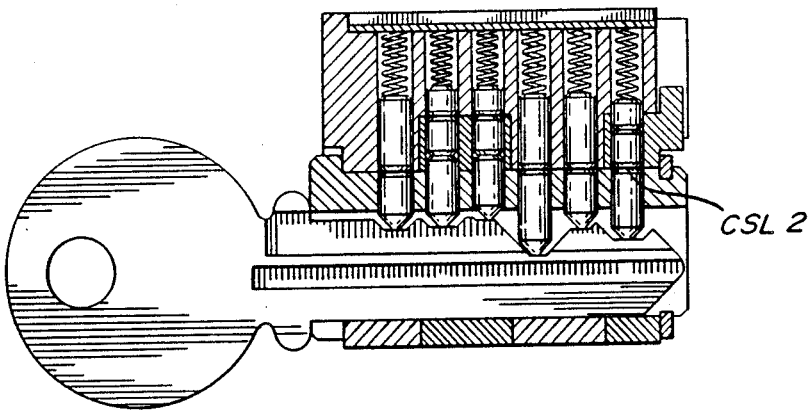
FIG. 19 illustrates the other control shear line thereof.

As will be apparent, two different control keys will be needed to extend the different lugs out of the core body in the two different directions. The two different keys will form two different control shear lines as illustrated in FIGS. 18 and 19. With control key No. 1, SCL 1 will be formed which will permit rotation of only control element 109, and with control key No. 2, SCL 2 will be formed which will permit rotation of only control element 107.

Figure 12:
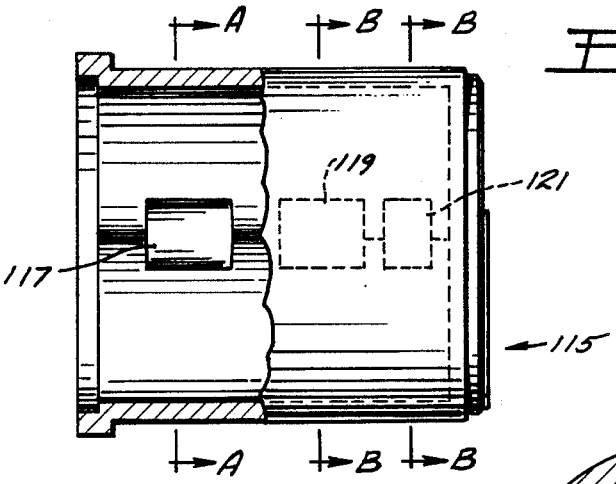
FIG. 12 shows one embodiment of a surrounding housing which can be used with the embodiment of the FIG. 10 core body.
Figure 13:
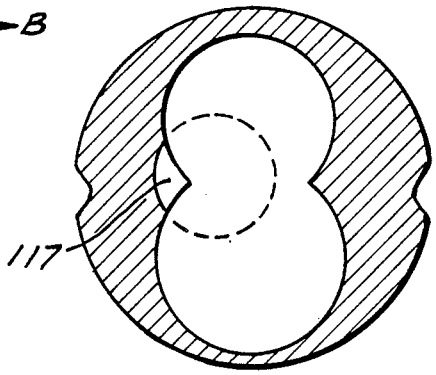
FIG. 13 is a section through A—A of FIG. 12.
Figure 14:
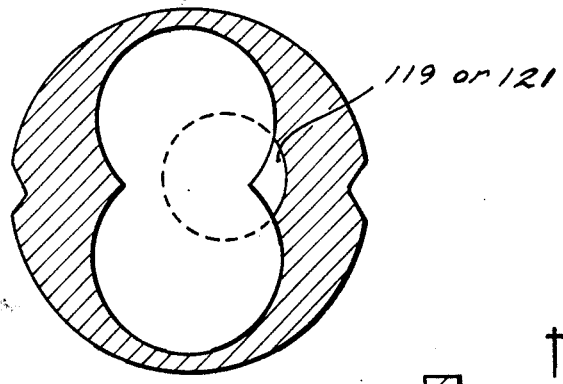
FIG. 14 is a section through B—B of FIG. 12.

As will also be apparent, the grooves for receiving the lugs will no longer be disposed in a single wall of the surrounding housing. Instead, grooves must be formed in opposing walls of the surrounding housing. One arrangement of the surrounding housing with grooves formed in opposing walls is illustrated in FIGS. 12 to 14. Referring to FIG. 14, once again, the surrounding housing is illustrated as a cylinder shell 115. Forward groove 117 is disposed in one wall of the cylinder shell, and central groove 119 and rear groove 121 are formed in the opposing wall. Before inserting the core body into the cylinder shell, both lugs are initially extended outside of the peripheral profile of the core body. (The key cannot be withdrawn unless the lugs are extended.) Control key No. 1 is inserted into the key hole of the plug, and the key is rotated counter clock-wise to retract lug 113 so that it is totally within the profile of the core body. The core body is then inserted into the cylinder shell 115. As lug 111 is still extended, it will not be possible to insert the core body all the way into the cylinder shell. Instead, the core body will be stopped when lug 113 is adjacent groove 119. The key is then rotated clock-wise so that lug 113 is moved into groove 119, and control key No. 1 is withdrawn. Control key No. 2 is then inserted and rotated clock-wise, and lug 111 is retracted to within the outline periphery of the core body. As the groove 119 is wider than lug 113, it will be possible to move the core body inwardly when lug 113 is in groove 119. The core body will then be moved inwardly until lug 111 is adjacent the forward end of forward groove 117. The key will then be rotated counter clock-wise so that lug 111 is in groove 117. Control key No. 2 is then removed and control key No. 1 is inserted. Lug 113 is then withdrawn to within the peripheral profile of the core body.

Once again, because groove 117 is wider than lug 111, it will be possible to move the core body inwardly until lug 113 is adjacent groove 121. Control key No. 1 is once again rotated so that lug 113 is disposed in groove 121, and the control key is once again removed.

Accordingly, lug 113 will be disposed in groove 121 and lug 111 will be disposed in groove 117. The forward edge of lug 111 will not be adjacent the forward edge of groove 117, but the forward edge of lug 113 will be adjacent the forward edge of groove 121.

Figure 15:
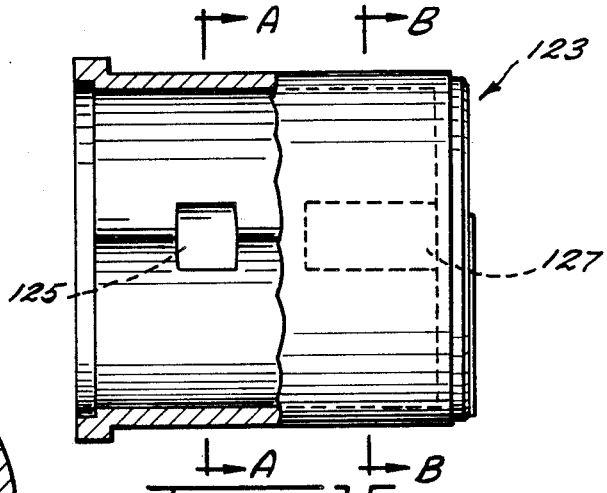
FIG. 15 shows an alternate surrounding housing for use with the core body of FIG. 10.
Figure 16:
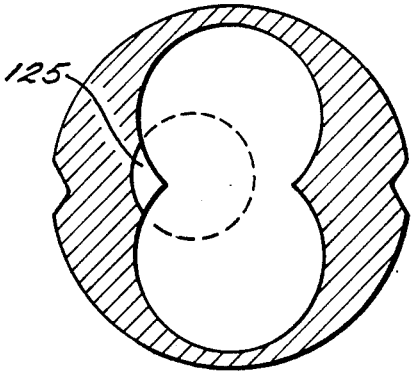
FIG. 16 is a section through A—A of FIG. 15.
Figure 17:
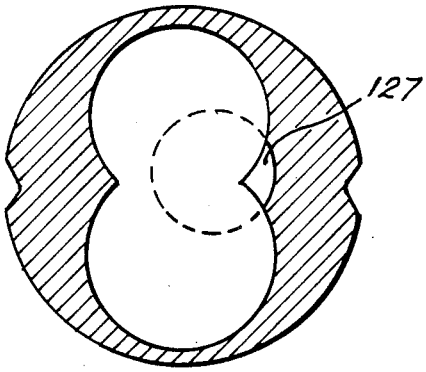
FIG. 17 is a section through B—B of FIG. 15.

An alternate embodiment of a surrounding housing is illustrated in FIGS. 15 to 17. In FIG. 15, the surrounding housing is once again a cylinder shell 123 having a groove 125 in one side wall and a groove 127 in an opposing side wall. Once again, initially, both lugs extend outside of the peripheral profile of the core body. Control key No. 1 is inserted and lug 113 is retracted to within the peripheral profile of the core body. The core body is then inserted into the cylinder shell. Once again, the core body will not be able to be completely inserted into the cylinder shell because lug 111 is extended and will prevent the core body from completely entering the cylinder shell. Nevertheless, the core body can be inserted far enough in so that lug 113 is disposed adjacent the forward end of groove 127. Control key No. 1 is rotated so that lug 113 extends into groove 127, and the control key is then withdrawn.

Control key No. 2 is then inserted to retract lug 111. Once again, groove 127 is wider than lug 113 so that, with lug 111 retracted, it is possible to move the core body all the way into the cylinder shell. At that time, lug 111 will be adjacent groove 125. Control key No. 2 is rotated so that lug 111 is disposed in groove 125. Control key No. 2 is then removed. At that time, lug 113 is disposed in groove 127, but the forward edge of lug 113 is not adjacent the forward edge of groove 127. On the other hand, the forward edge of lug 111, which is disposed in groove 125, is adjacent the forward edge of groove 125.

Although several embodiments have been described, this was for the purpose of illustrating, but not limiting, the invention Various modifications, which will come readily to the mind of one skilled in the art, are within the scope of the invention as defined in the appended claims.

I claim:

1. A key removable core body for insertion into a surrounding housing, comprising:

a plug housing and a tumbler pin housing, the cross-section of said core body defining a peripheral profile;

a plug supported for rotation in said plug housing;

a plurality of tumbler pin bores extending through said tumbler pin housing, said tumbler pin bores being configured in a predetermined arrangement along the length of said tumbler pin housing;

a like plurality of tumbler pin bores extending into said plug, and being configured in the same arrangement as said predetermined arrangement, along the length of said plug;

whereby, said tumbler pin bores of said tumbler pin housing can be aligned with said tumbler pin bores of said plug;

at least two separate control elements comprising a part of said plug housing, each of said control elements comprising a retainer lug, said retainer lug being movable between a retracted position, when each said retainer lug is substantially completely within said profile, and an extended position when each said retainer lug projects laterally of said core body outside of said profile;

whereby, when all of said control elements are in their extended position, said core body is restrained from removal thereof from said surrounding housing.

2. A core body as defined in claim 1 wherein each said control element comprises:

a lower ring portion;

a thickened portion;

the lug of each said control element extending from its thickened portion.

3. A core body as defined in claim 2 wherein each said lower ring portion of said control elements is mounted in a separate recess in said plug housing.

4. A core body as defined in claim 3 wherein each said lug projects laterally on the same side of said core body.

5. A core body as defined in claim 3 wherein at least one lug of one of said control elements projects laterally from one side of said core body; and at least another one of said lugs of another one of said control elements projects laterally from the other side of said core body.

* * * * *